US006263589B1

(12) United States Patent
Vainio

(10) Patent No.: US 6,263,589 B1
(45) Date of Patent: Jul. 24, 2001

(54) METHOD OF DRYING A FIBER WEB, AND ARRANGEMENT IN A FIBER WEB DRYING APPARATUS

(75) Inventor: Veli-Matti Vainio, Tampere (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/563,082

(22) Filed: May 1, 2000

Related U.S. Application Data

(63) Continuation of application No. PCT/FI98/00870, filed on Nov. 10, 1998.

(30) Foreign Application Priority Data

Nov. 11, 1997 (FI) ..... 974199

(51) Int. Cl.[7] ..... F26B 7/00

(52) U.S. Cl. ..... 34/419; 34/355; 34/392; 34/560; 34/561; 34/71; 34/95; 34/116

(58) Field of Search ..... 34/392, 417, 418, 34/419, 449, 452, 454, 560, 561, 71, 95, 116, 117, 124; 162/206, 207, 359.1, 360.3

(56) References Cited

U.S. PATENT DOCUMENTS 4,461,095 7/1984 Lehtinen .
4,719,707 * 1/1988 Klapp ..... 34/94
5,071,513 * 12/1991 Bluhm et al. ..... 162/206
5,594,997 * 1/1997 Lehtinen ..... 34/95
5,619,806 * 4/1997 Warren ..... 34/331
5,706,587 * 1/1998 Lehtinen et al. ..... 34/71

OTHER PUBLICATIONS

World Intellectual Property Organization, Int'l Application No. PCT/FI95/00559, Int'l Publication No. WO 96/11300, Int'l. Publication Date Apr. 1996.

* cited by examiner

*Primary Examiner*—Pamela Wilson
(74) *Attorney, Agent, or Firm*—Alston & Bird LLP

(57) ABSTRACT

The invention relates to a method of drying a fiber web and an arrangement in a fiber web drying apparatus, the fiber web being dried between two tight bands that move in parallel in the same direction and turn around turning rolls. The first band is heated and the second band is cooled. The fiber web is guided through a drying zone, defined by the bands, with at least one felt or wire, so that the fiber web comes into contact with the surface of the first, heated band and the felt or wire is between the fiber web and the second, cooled band. The position of the edge of the band is measured by means of a sliding block which is brought into contact with the edge of the band, the material of the sliding block being substantially harder than that of the band.

18 Claims, 1 Drawing Sheet

METHOD OF DRYING A FIBER WEB, AND ARRANGEMENT IN A FIBER WEB DRYING APPARATUS

CROSS-REFERENCE TO RELATED APPLICATIONS

This application is a continuation of pending PCT International Application PCT/FI98/00870, filed Nov. 10, 1998, designating inter alia the United States.

FIELD OF THE INVENTION

The invention relates to a method of drying a fiber web, in which the fiber web is dried by a drying apparatus comprising two endless bands that are impermeable to air, first turning rolls, around which the first band is arranged to turn, and second turning rolls, around which the second band is arranged to turn, the first and second bands being arranged to run part of the way in parallel such that they define a drying zone between them, the first band being heated and the second band being cooled, a fiber web and at least one felt or wire being arranged to run between the bands such that the fiber web is in contact with the first, heated band, and the felt or wire is between the fiber web and the second, cooled band; and the position of the edge of the band is measured.

The invention further relates to an arrangement in a fiber web drying apparatus comprising two endless bands that are impermeable to air, first turning rolls, around which the first band is arranged to turn, and second turning rolls, around which the second band is arranged to turn, the first and second bands being arranged to run part of the way in parallel such that they define a drying zone between them, the first band being arranged to be heated by heating means, and the second band being arranged to be cooled by cooling means, a fiber web and at least one felt or wire being arranged to run between the bands such that the fiber web is in contact with the first, heated band, and the felt or wire is between the fiber web and the second, cooled band; the arrangement comprising means for measuring the position of the edge of the band.

BACKGROUND OF THE INVENTION

Many patent publications, such as WO 96/11300 and U.S. Pat. No. 4,461,095, teach the drying of a fiber web between two parallel metal bands moving in the same direction such that the fiber web is in contact with the heated metal band and that there is a wire between the fiber web and the second, cooled metal band, whereby the steam separated from the fiber web by heating condenses to the wire by the effect of the cold metal band. The basic idea is that two endless metal bands are arranged to run around turning rolls and that against the inner surface defined by the loops that the bands form are provided pressure chambers containing hot steam and water, respectively, such that the pressure produced presses the hot and cold bands, respectively, against the fiber web and the felt running between them. Together with seals, the bands located between the pressure chambers form one side of the pressure chambers such that the steam and water can directly affect the bands. The operation of the apparatus is fully known per se and has been disclosed, for example, in the above patent publications, which are incorporated herein by reference.

A piece of information needed in the above-described control and adjustment of the drying apparatus is the position of the bands crosswise of the machine direction. The position of the edge of the band is measured using a sensor that forms a fork, inside which the edge of the band can move. In both branches of the fork there are optical fibers that form a kind of light nozzle. The light travels from the light-transmitting fiber ends through the air to the light-receiving fiber ends, unless there is a band edge preventing the light from travelling. The edge of the band partly covers the light nozzle, whereby the output signal of the sensor is proportional to the area covered by the band. In the fiber web drying apparatus environment, impurities, however, may cover the light nozzle and the ends of the fibers, and this may change the readings of the sensor, i.e., the sensor will no longer be reliable: it is prone to malfunction and requires much maintenance. The vertical motion of the band is also rather restricted, since the band damages the fibers when it comes into contact with them. Further, the sensor is difficult to adjust, and its readings are not reliable. The settings of the sensor are not stable, which is another reason why the sensor requires much calibration and maintenance. Further, the sensor is rather expensive.

SUMMARY OF THE INVENTION

The object of the present invention is to provide a method and an arrangement in which the above drawbacks can be avoided.

The method of the invention is characterized in that the position of the edge of the band is measured by bringing a sliding block into contact with the edge of the band, the material of the sliding block being harder than that of the band.

Further, the arrangement of the invention is characterized in that the means for measuring the position of the edge of the band comprise a sliding block, which is made of harder material than the band and which is arranged to come into contact with the edge of the band.

The essential idea of the invention is that the edge position of two endless bands one heated, one cooled—running in parallel in the same direction and forming a loop is measured by contacting the edge of the band. The contact is so light that the edge of the band is not damaged. Another essential idea is that the block coming into contact with the edge of the band is substantially harder than the band. In a preferred embodiment, the block coming into contact with the edge is arranged by means of springs in a rod whose mass is greater than that of the block. In another preferred embodiment, a damper is arranged in the rod for damping and preventing oscillation of the rod.

The advantage of the invention is that the sensor is reliable, gives accurate results, and does not require much maintenance. The block coming into contact with the edge of the band keeps the edge of the band clean, but it does not wear nor damage the band. The measuring system is also simple, accurate and reliable, and also inexpensive. When the block coming into contact with the edge of the band is connected by means of springs to a rod whose mass is greater than that of the block, the transfer of any minor roughnesses from the edge of the band to the measuring sensor can be prevented, whereby the measuring sensor can define the displacement of the band fairly evenly. The oscillation and vibration of the rod can be prevented by the dampers arranged in the rod.

BRIEF DESCRIPTION OF THE DRAWINGS

The invention will be described in greater detail in the attached drawing, in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
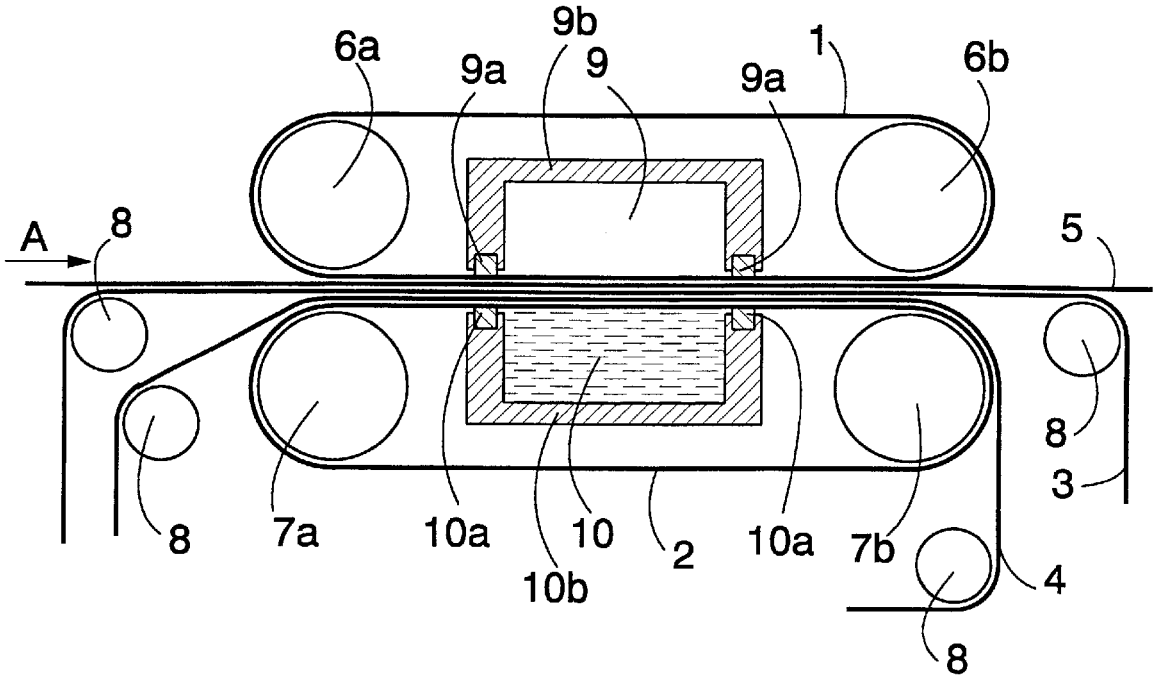
FIG. 1 is a schematic sectional side view of a fiber web drying apparatus of the invention taken in the travel direction of the web.

FIG. 1 is a schematic sectional side view of an arrangement according to the invention taken in the travel direction of the web. The arrangement comprises a drying apparatus comprising a first band 1, or upper band, and a second band 2, or lower band, which are endless bands that are impermeable to air, have a good thermal conductivity, and are preferably made of metal, a fine wire or felt 3, a coarse wire 4 and a fiber web 5 passing between those surfaces of the bands which face each other. The fiber web 5 moves in the direction indicated by arrow A. The first band 1 is arranged to turn around first turning rolls 6*a*, 6*b* located at the ends of the drying apparatus. Correspondingly, the second band 2 is arranged to turn around second turning rolls 7*a*, 7*b* located below the first turning rolls 6*a*, 6*b* at the ends of the drying apparatus. The wires 3, 4 are supported and guided by guide rolls 8. Since the pressure prevailing in the drying zone in the area between the bands 1, 2 is usually different from the pressure prevailing outside or on the sides of the bands 1, 2, seals are arranged on both sides of the apparatus between or at the edges of the bands 1, 2, said seals preventing liquid or vapor from escaping from the space between the bands 1, 2 through the sides, or vice versa. To effect the vapor heating required by the drying process, the drying apparatus comprises a pressure chamber 9, which is located above the first band 1. The first band 1 is sealed with seals 9*a* in respect of the body 9*b* of the pressure chamber 9 such that the steam in the pressure chamber 9 is maintained at a suitable pressure. Below the second band 2 there is a water chamber 10, which contains a cooling medium, such as water, that cools the second band 2. At the edges of the water chamber 10 there are seals 10*a,* with which the second band 2 is sealed in respect of the body 10*b* of the water chamber 10.

The operation of the drying apparatus is based on heating the first band 1, which comes into contact with the web 5, with hot steam contained in the pressure chamber 9, whereby the water in the web 5 is vaporized and transferred through the wires 3, 4 toward the second band 2 by the effect of the temperature of the first band 1. The second band 2, in turn, is continuously cooled with the water located below it, whereby the steam produced on the surface thereof condenses into water and is removed with the band 2 and the wire 4.

Figure 2:
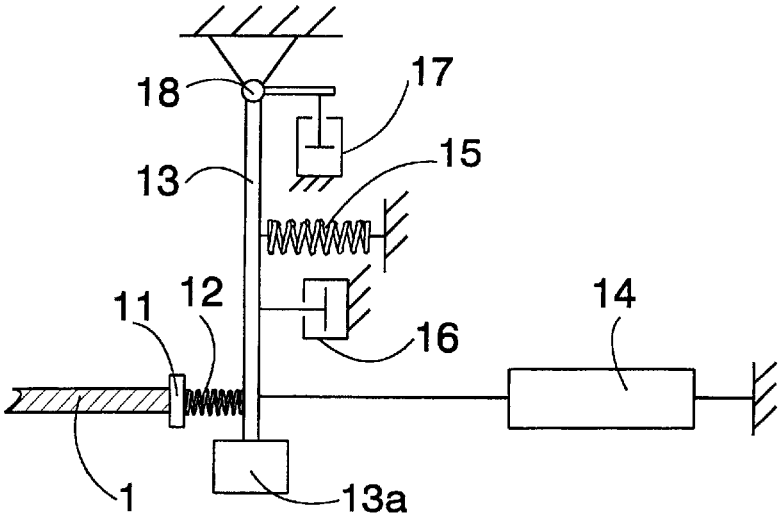
FIG. 2 is a schematic partly sectional view of a detail of an arrangement according to the invention taken in the travel direction of the web.

FIG. 2 shows a detail of the arrangement of the invention. A sliding block 11 is arranged to come into contact with the edge of the band 1. The material of the sliding block 11 is substantially harder than that of the band 1, whereby the sliding block 11 has fairly good wear-resistance. Such materials are, for example, diamond and boron nitride. When the sliding block 11 comes into contact with the edge of the band 1, it cleans the edge and even slightly smoothens any roughnesses at the edge of the band 1. The contact between the sliding block 11 and the edge of the band 1, however, is arranged to be so light that the edge of the band 1 is not damaged by the sliding block 11.

The sliding block 11 is connected to a rod 13 by means of a spring or springs 12. There is preferably more than one spring 12, which makes the mechanism reliable. Preferably, the springs 12 are connected to the sliding block 11 by a clip, and guides are arranged around the springs 12. For the sake of clarity, these structures are not shown in FIG. 2. The mass of the rod 13 is arranged to be substantially greater than that of the sliding block 11, whereby the small reciprocating movements of the sliding block 11 do substantially not move the rod 13. The slight roughnesses at the edge of the band 1 do thereby not cause a substantial displacement of the rod 13. Instead, when the edge of the band 1 is moved, the sliding block 11 moves in the same direction, thereby moving the rod 13, which is arranged to turn about a hinge. If the rod 13 is of so light material that its mass is too small, the mass can be increased, for example, by attaching an additional weight 13*a* to the rod 13. To the rod 13 is connected a sensor 14, which measures the position of the rod 13, thereby giving the position of the edge of the band 1. The sensor 14 is encased so that the environment cannot have a detrimental effect on the measuring result given by it. The structure of the sensor 14 is fully known per se, and so it will not be discussed in greater detail herein.

The pressing of the rod 13 against the edge of the band 1 in each lateral position of the edge of the band 1 is ensured, for example, by means of a spring 15. Instead of the spring 15, the member producing the contact force of the rod 13 can also be, for example, a cylinder or a counterbalance. A separate member is not necessarily needed; a hinge about which the rod 13 can turn can be arranged so that the weight of the rod 13 presses the rod 13 against the edge of the band 1 in all situations.

The arrangement further comprises a damper 16, which is arranged to damp the movement of the rod 13. The damper 16 prevents and damps the vibration and oscillation of the rod 13. The damper 16 can be, for example, a viscose damper or a friction damper. The absorption can also be implemented, for example, by a magnetic field or by some other method that is fully known per se. Further, the oscillation frequencies of the sliding block 11 and the rod 13 are designed to be such that the sliding block 11 and the rod 13 will not start oscillating together.

For example, when the band 1 is changed or when other maintenance is conducted, the rod 13 and thereby the sliding block 11 can be turned about a hinge 18 of the rod 13 by means of a disengaging device 17 so that the sliding block is detached from the edge of the band 11. The disengaging device can be, for example, a compressed-air cylinder or some other such member that is fully known per se and suits the purpose. Each band 1, 2 has its own arrangement for measuring the position of the edge of the band, and each band may also have more than one such arrangement.

The drawing and the associated description are intended only to illustrate the idea of the invention. The invention may vary in its details within the scope of the claims. It is thus not essential what pressure medium is used in the pressure chamber 9 and the water chamber 10. The pressure medium in the pressure chamber 9 can thus be, for example, steam, air, hot fuel combustion products or water. In the water chamber 10, for example, air can be used as pressure medium in addition to water.

In addition to the heating by the pressure chamber 9, the first band 1 can also be heated at other places in ways that are fully known per se. Further, the first band 1 can also be heated entirely outside the pressure chamber 9, or the fiber web 5 can also be dried even without the pressure chamber 9.

Further, the second band 2 can also be cooled outside the water chamber 10, or it can even be cooled entirely without the water chamber 10 in ways that are fully known per se.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of drying a fiber web, comprising:

advancing a first endless band that is impermeable to air around first turning rolls;

advancing a second endless band that is impermeable to air around second turning rolls, the first and second bands being arranged to advance at least partly in parallel such that they define a drying zone between them, heating the first band;

cooling the second band;

advancing a fiber web and at least one felt or wire between the bands such that the fiber web is in contact with the first, heated band, and the felt or wire is between the fiber web and the second, cooled band; and measuring the position of an edge of the band by bringing a sliding block into contact with the edge of the band, the material of the sliding block being harder than the material of the band.

2. A method as claimed in claim 1, wherein the position of the edge of the band is measured by measuring the position of the sliding block.

3. A method as claimed in claim 1, wherein the sliding block is connected to a rod with at least one spring member, the mass of the rod being substantially greater than that of the sliding block.

4. A method as claimed in claim 3, wherein the position of the edge of the band is measured by measuring the position of the sliding block, and the position of the sliding block is measured by measuring the position of the rod.

5. A method as claimed in claim 3, wherein the movement of the rod is damped.

6. A method as claimed in claim 1, wherein the band is a metal band.

7. A method as claimed in claim 1, wherein the sliding block is made of diamond.

8. A method as claimed claim 1, wherein the sliding block is made of boron nitride.

9. A method as claimed in claim 1, wherein the first band is heated by a pressure chamber and the second band is cooled by a chamber containing a pressurized medium.

10. An arrangement in a fiber web drying apparatus comprising:

a first endless band that is impermeable to air;

first turning rolls around which the first band is arranged to turn;

a second endless band that is impermeable to air;

second turning rolls around which the second band is arranged to turn, the first and second bands being arranged to run at least partly in parallel such that they define a drying zone between them;

a heating device for heating the first endless band;

a cooling device for cooling the second endless band;

at least one felt or wire being arranged to run between the bands such that the fiber web is in contact with the first, heated band, and the felt or wire is between the fiber web and the second, cooled band; and a sliding block for measuring the position of an edge of the band, the sliding block being made of a harder material than the band and being arranged to come into contact with the edge of the band.

11. An arrangement as claimed in claim 10, wherein the arrangement comprises a sensor, which is arranged to measure the position of the sliding block.

12. An arrangement as claimed in claim 11 further comprising a rod arranged between the sensor and the sliding block, the mass of the rod being substantially greater than that of the sliding block, and at least one spring member connecting the rod and the sliding block.

13. An arrangement as claimed in claim 12, wherein the arrangement comprises a damper, which is arranged to damp the movement of the rod.

14. An arrangement as claimed in claim 10, wherein the arrangement comprises a disengaging device for disengaging the sliding block, if desired, so that it is not in contact with the band.

15. An arrangement as claimed in claim 10, wherein the band is a metal band.

16. An arrangement as claimed in claim 10, wherein the sliding block is made of diamond.

17. An arrangement as claimed in claim 10, wherein the sliding block is made of boron nitride.

18. An arrangement as claimed in claim 10, wherein the drying apparatus comprises a pressure chamber, which is arranged to heat the first band, and a pressurized-medium-containing chamber, which is arranged to cool the second band.

* * * * *